US008309872B2

(12) United States Patent
Peter et al.

(10) Patent No.: US 8,309,872 B2
(45) Date of Patent: Nov. 13, 2012

(54) INSULATING SWITCHING ROD

(75) Inventors: Marianne Peter, Berlin (DE); Gottfried Schuster, Dresden (DE); Ralf-Reiner Volkmar, Oldenburg (DE)

(73) Assignee: Siemens Aktiengesellschaft, Munich (DE)

( * ) Notice: Subject to any disclaimer, the term of this patent is extended or adjusted under 35 U.S.C. 154(b) by 223 days.

(21) Appl. No.: 12/677,154

(22) PCT Filed: Sep. 10, 2008

(86) PCT No.: PCT/EP2008/061966

§ 371 (c)(1),
(2), (4) Date: Aug. 26, 2010

(87) PCT Pub. No.: WO2009/034092

PCT Pub. Date: Mar. 19, 2009

(65) Prior Publication Data

US 2010/0307893 A1 Dec. 9, 2010

(30) Foreign Application Priority Data

Sep. 11, 2007 (DE) ..... 10 2007 044 244

(51) Int. Cl.
*H01H 33/42* (2006.01)

(52) U.S. Cl. ..... 218/118; 218/140; 218/154

(58) Field of Classification Search ..... 200/400, 200/401; 218/78, 92, 118, 120, 134, 140, 218/153, 154; 361/115, 133, 135; 267/166, 267/170, 174–179; 185/37, 45

See application file for complete search history.

(56) References Cited

U.S. PATENT DOCUMENTS

| | | | | |
|---|---|---|---|---|
| 3,663,906 | A * | 5/1972 | Barkan et al. | 335/195 |
| 4,053,857 | A * | 10/1977 | Guraydin | 335/147 |
| 4,381,435 | A * | 4/1983 | Barkan | 218/140 |
| 4,713,503 | A * | 12/1987 | Kamp | 218/140 |
| 5,808,258 | A | 9/1998 | Luzzi | |
| 5,864,942 | A | 2/1999 | Luzzi | |
| 6,373,675 | B1 * | 4/2002 | Yamazaki et al. | 361/135 |
| 6,927,356 | B2 * | 8/2005 | Sato et al. | 218/154 |
| 2001/0025830 | A1 * | 10/2001 | Allard et al. | 218/118 |
| 2009/0078681 | A1 * | 3/2009 | Marchand et al. | 218/140 |
| 2010/0078302 | A1 * | 4/2010 | Erk et al. | 200/400 |

FOREIGN PATENT DOCUMENTS

| | | | |
|---|---|---|---|
| DE | 1563133 | A1 | 11/1969 |
| DE | 3742459 | A1 | 6/1989 |
| DE | 270172 | A1 | 7/1989 |
| DE | 9203990 | U1 | 7/1992 |
| DE | 9319264 | U1 | 2/1994 |
| DE | 19716956 | A1 | 10/1998 |
| DE | 69620132 | T2 | 9/2002 |

(Continued)

*Primary Examiner* — Michael Friedhofer
(74) *Attorney, Agent, or Firm* — Laurence A. Greenberg; Werner H. Stemer; Ralph E. Locher

(57) ABSTRACT

An insulating switching rod has a drive element for initiating a drive movement in an electrical contact system of a switching device and for producing a contact force when the contact system is in the closed state. The system further includes a clamping apparatus for the drive element of the switching rod in order to maintain the contact force. The object is to produce a greater contact force with a compact design and ensure constant spring characteristics as well as low wear over the entire useful life. For that purpose, the switching rod and the drive element can be directly or indirectly connected to one another by way of a plug and latching connection.

10 Claims, 6 Drawing Sheets

FOREIGN PATENT DOCUMENTS

| | | | | |
|---|---|---|---|---|
| EP | 0782162 | A2 | | 7/1997 |
| EP | 1367616 | A1 | * | 12/2003 |
| GB | 1114868 | A | | 5/1969 |
| JP | 2004241373 | A | | 8/2004 |

* cited by examiner

INSULATING SWITCHING ROD

BACKGROUND OF THE INVENTION

Field of the invention

The invention relates to an insulating switching rod having a drive element for introduction of a drive movement into an electrical contact system of a switching device and for production of a contact force in the closed state of the contact system having a stressing apparatus for the drive element of the switching rod in order to maintain the contact force.

An insulating switching rod such as this is known from the prior art. In switching devices, for example circuit breakers, having an electrical contact system which is arranged in a vacuum interrupter, wherein a drive movement is introduced to the contact system via a drive unit, the insulating switching rod is used on the one hand for galvanic isolation of the drive unit from the contact system, and on the other hand for introduction of the drive movement and for production of a contact force, which remains essentially constant, when the contact system is in the closed state. For this purpose, the insulating switching rod comprises a stressing apparatus, which is arranged in a cavity in the switching rod and acts between a drive element and a housing of the switching rod, such that the stressing apparatus maintains the contact force on the contact system in the closed state.

In the case of the insulating switching rod known from the general prior art, the stressing apparatus comprises an arrangement of helical compression springs, which produce the contact force. In this case, the helical compression spring is surrounded by a housing part which is in turn integrated in a housing part for the switching rod, wherein both the two housing parts and the connecting and/or covering parts of the housing parts, are composed of insulating material. In this case, the housing parts are attached to one another by means of a screw connection and are attached to the switching device by means of a flange, as is known, by way of example, from DE 197 16 956 A1, DE 9319264 U1 or DE 9203990 U1. In addition, DE 3742459 A1 discloses a clamping connection instead of a screw connection. This represents a particularly complicated and complex design.

BFIEF SUMMARY OF THE INVENTION

The object of the present invention is to develop an insulating switching rod of the type mentioned initially such that it is of simple design and can be installed easily, with the aim of no torsional moments being introduced into the switching contact system during fitting.

According to the invention, this object is achieved in the case of an insulating switching rod of the type mentioned initially in that the switching rod and the drive element can be connected indirectly or directly by means of a plug and latching connection.

A plug and latching connection of the switching rod and drive element advantageously allows simple fitting, in which case a high contact force is produced on the switching device contacts, in particular the switching tube contacts, by the plug and latching connection during the joining and latching-in processes by further compression of the stressing apparatus which, for example, is in the form of a helical compression spring. The switching rod which can be fitted in the switching device can therefore move virtually integrally owing to the prestressing spring force of the stressing apparatus, and can be broken down into its individual parts again by means of deliberate application of external force and torque, only when it has been removed from the switching tube. Furthermore, the plug and latching connection makes it possible to reduce the insulating parts of the switching rod to two insulating bodies. As a result of the avoidance of the metal parts which are required in the prior art, the insulating switching rod according to the invention can also be produced easily and at low cost.

One possible simple embodiment of the invention provides that the plug and latching connection is in the form of a bayonet fitting. This allows the switching rod and the drive element to be mechanically connected easily and such that the connection can be made and broken quickly. In this case, these items are connected and pressed against one another by plugging them into one another and rotating them with respect to one another. In addition, a catch can be provided in order to secure the connection.

In one simple embodiment, the switching rod and the drive element are each surrounded by an associated insulating body which can be plugged into one another and can be connected to one another such that they can be latched. Only two insulating bodies or insulating parts are therefore still required, into which one or more spring elements, in particular helical compression springs, can be inserted as the stressing apparatus. In this case, the two insulating bodies can be produced in a simple manner by casting, injection molding, or by some other suitable method for production of the complex body geometry.

One of the insulating bodies, in particular the insulating body which surrounds the switching rod, is expediently mounted in a fixed position and therefore stationary, and the insulating body which surrounds the drive element is mounted such that it can move. This allows the drive element to be fitted and removed easily by handling a single moving insulating body, which can be fitted to or inserted in the stationary insulating body and can be guided and latched therein such that it can move longitudinally and can rotate.

Depending on the embodiment, the stressing apparatus is associated with one of the insulating bodies. For example, at least that insulating body which is associated with the switching rod has a cavity in which a helical compression spring arrangement is arranged as the stressing apparatus and comprises at least one helical compression spring, which is arranged around the switching rod. Alternatively or additionally, the stressing apparatus may comprise a helical compression spring which is arranged around the drive element. A plurality of separate helical compression springs, and/or helical compression springs which are interleaved in one another, can in each case also be arranged around the drive element and/or the switching rod. In other words: the stressing apparatus, which is in the form of a helical compression spring arrangement, may comprise separate helical compression springs which are located opposite one another and a plurality of helical compression springs which are wound in opposite senses and are interleaved in one another and which overall produce a large spring force. In particular, a stressing apparatus such as this makes it possible to produce large contact forces of 3500 N to 5000 N with a working travel of between 0 mm and 5 mm in a compact physical volume, with the helical compression spring arrangement having an average spring rate of 200 N/mm with an unstressed length of about 100 mm, and with a predetermined internal and external turn diameter. Furthermore, the resistance of the helical compression spring arrangement to kinking is advantageously substantially improved because individual helical compression springs, or a plurality of helical compression springs opposite one another, are guided in a robust form, or the helical compression springs which are wound in opposite senses provide mutual robustness against kinking, thus reducing the wear on the apparatus. Furthermore, the helical compression spring arrangement has no edges, thus reducing friction effects on the wall of the cavity and reducing the wear on the spring. In addition, in comparison to the previously normal cup springs, helical compression springs have a flatter characteristic, resulting in a comparatively constant contact force.

For a plug and latchable connection of the two insulating bodies, these bodies are in a further advantageous embodiment provided on the inside and/or on the outside with latching grooves and/or latching hooks. The insulating bodies are advantageously provided with mutually corresponding latching grooves and latching hooks which, when plugged and latched together, engage in one another in an interlocking and force-fitting manner. In order to improve the impact resistance of the latching hooks or pins of the moving insulating body when loaded with an impact, for example during a switching process, reinforcing elements can additionally be provided, for example metallic round straps which are integrated in a star shape.

In addition, for simple, reliable and largely play-free guidance of the moving insulating body of the switching rod during fitting or removal, guide grooves can be provided on at least one of the insulating bodies, in particular on the inside or outside of the stationary insulating body. The guide grooves can be provided with a suitable lubricant for reliable guidance. The latching grooves may also be used as guide grooves.

The invention will be explained in more detail in the following text, using the drawings and one exemplary embodiment, with reference to the attached figures, in which:

DESCRIPTION OF THE INVENTION

Mutually corresponding parts are provided with the same reference symbols in all the figures.

Figure 1:
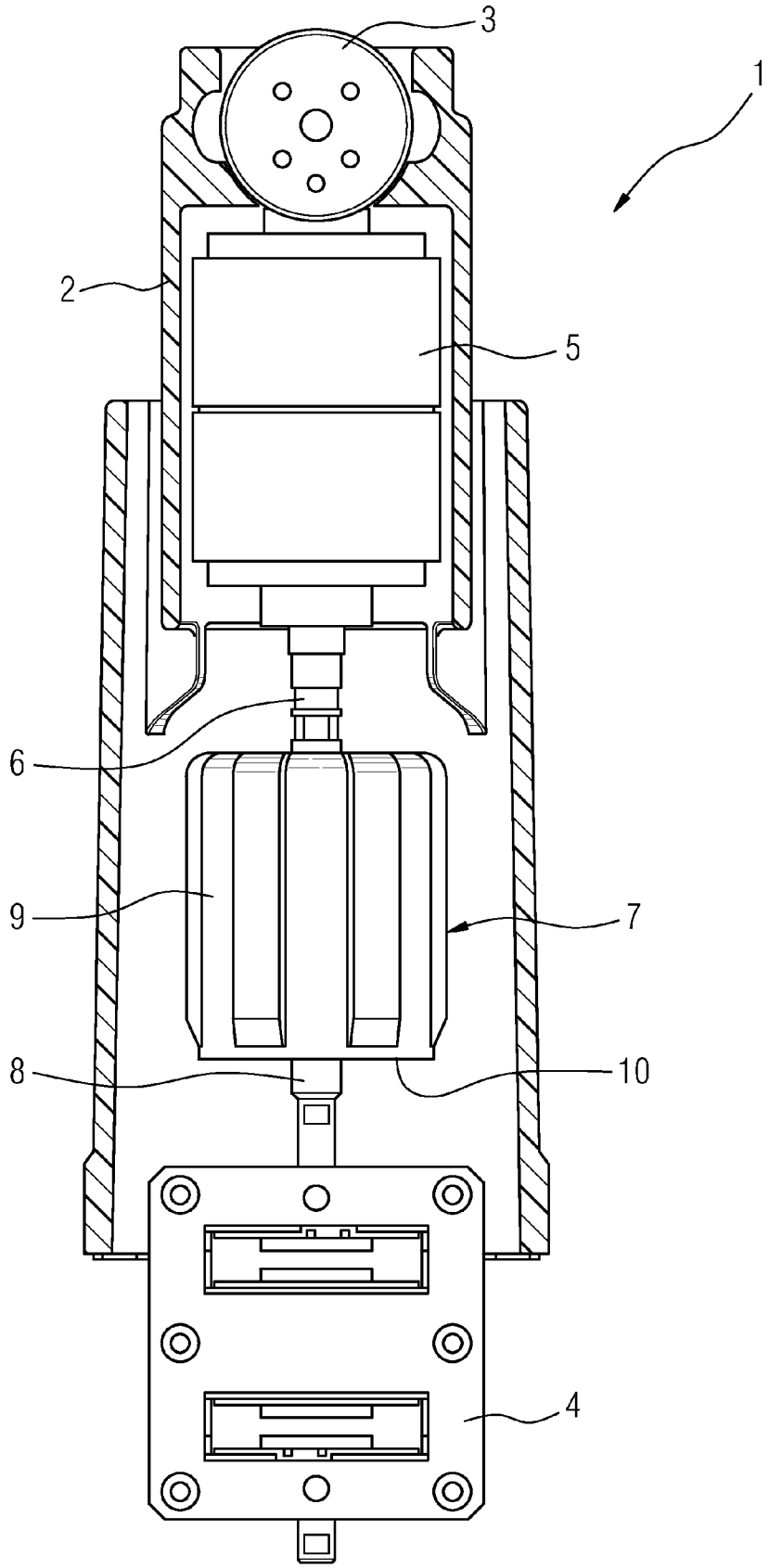
FIG. 1 shows a switch pole of a switching device having an insulating switching rod according to the invention with a drive element.

FIG. 1 shows a switch pole 1 of a circuit breaker, which is known per se, for switching and interrupting currents in a polyphase AC power supply system. The switch pole 1 has an insulating material housing 2 in which a first connecting piece 3 and a second connecting piece, which is not illustrated, are arranged for connection to busbars and outgoer conductors of the switching device, which are not illustrated in the figures. A drive unit 4 is provided for introducing a drive movement into an electrical contact system of a switching device which is in the form of a vacuum interrupter 5.

An electrically conductive connection between the first connecting piece 3 and the second connecting piece, which is not illustrated, via the contact system of the vacuum interrupter 5 can be made and broken by means of the drive unit 4 which, for example, is in the form of a magnetic drive. In this case, a moving contact element, which is not illustrated, of the vacuum interrupter 5 can be moved by means of an insulating switching rod 7, which comprises a conductive connecting rod 6, by a drive element 8 which is in the form of a drive bolt (referred to in the following text as the drive bolt 8). In the process, the drive unit 4 engages in the drive bolt 8 in order to initiate the drive movement, in particular a translational movement and/or a rotary movement.

Furthermore, the insulating switching rod 7 comprises the connecting rod 6. The insulating switching rod 7 and the drive bolt 8 are respectively surrounded by an associated insulating body 9 and 10. The insulating bodies 9 and 10 are composed of insulating material. The connecting rod 6 and the drive bolt 8 are in this case part of the insulating switching rod 7, which will be explained in more detail further below with reference to FIGS. 2 to 8.

The insulating switching rod 7 is mechanically coupled to the drive unit 4 via the drive bolt 8, via which a drive movement is introduced into the moving contact element of the vacuum interrupter 5.

Figure 2:
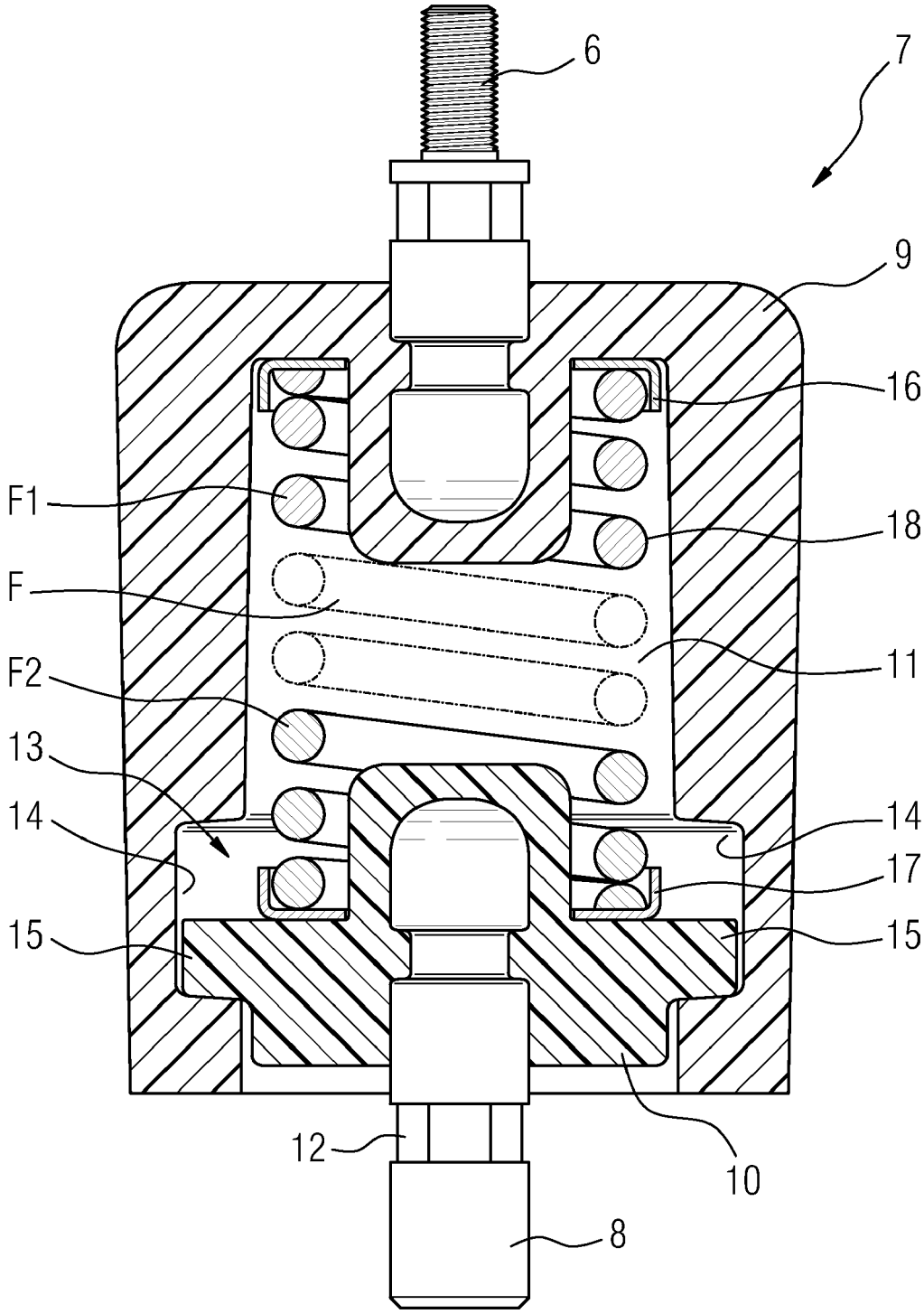
FIG. 2 shows a detail view of the insulating switching rod according to the invention with a drive element, with these having mutually associating plug and latchable insulating bodies with latching and guide grooves on the inside.

FIG. 2 shows a detail view of the insulating switching rod 7 with the drive bolt 8 from FIG. 1.

The insulating switching rod 7 comprises the insulating body 9 in which the connecting rod 6 is encapsulated. The drive bolt 8 is encapsulated in the insulating body 10. In this exemplary embodiment, the insulating body 9 has a cylindrical cavity 11 which is closed by means of the other insulating body 10. The connecting rod 6, which is encapsulated in the insulating body 9, and the drive bolt 8, which is encapsulated in the insulating body 10, expand, surrounded by the insulating material, from the respective bottom of the insulating bodies 9 or 10, cylindrically. The drive bolt 8 furthermore has a section 12 like a connection, which is used to hold a connecting element, which is not illustrated in any more detail.

The two insulation bodies 9 and 10 can be plugged into or onto one another and can be connected to one another such that they can be latched, via a plug and latching connection 13. For this purpose, the insulating body 9, together with the connecting rod 6 which is linked to the vacuum interrupter 5, are designed to be stationary, and therefore fixed. The insulating body 10 together with the drive bolt 8 is designed such that it can move, and in particular can move longitudinally and can rotate.

In order to limit the movement of the drive bolt 8, at its open end 13, the cavity 11 has a cutout which is introduced into the wall of the fixed insulating body 9, is for example circumferential in the form of segments, is in the form of a groove, and is used as a latching groove 14. The moving insulating body 10 for this purpose correspondingly has a cantilever arm, which is used as a latching hook 15, is guided in the latching groove 14 and can be latched in a final position. The height of the latching groove 14 limits the movement of the insulating body 10, which is guided in the latching groove 14 such that it can move longitudinally and can rotate, and is therefore used as a stop element. In this case, the height of the latching groove 14 is chosen such that it is considerably greater than the height of the latching hook 15. Furthermore, the height or the profile of the latching groove 14 is chosen such that a prestressing force is created by means of the stressing apparatus 18.

A helical compression spring arrangement (referred to in the following text as the helical compression spring arrangement 18) having at least one helical compression spring F is arranged as the stressing apparatus 18 in the cavity 11. If there is only a single helical compression spring F, the helical compression spring arrangement 18 is prestressed between a spring cup 16, which is arranged in the bottom area of the cavity 11, and a further spring cup 17, which is arranged in the bottom area of the insulating body 10. In this case, the helical compression spring F has an internal diameter which corresponds to the external diameter of the cylindrical projections from the bottom areas of the two insulating bodies 9 and 10, such that the helical compression spring F is guided on the inner wall of these projections.

Alternatively, the helical compression spring arrangement 18 may comprise two separate helical compression springs F1 and F2, which are arranged opposite one another on the connecting rod 6 and on the drive bolt 8, respectively, and are moved toward one another and are prestressed when the drive bolt 8 is operated.

On the one hand, galvanic isolation is provided between the drive unit 4 and the contact system of the vacuum interrupter 5 by an insulating switching rod 7 such as this with a drive bolt 8 in a switching device, since a drive movement of the drive unit 4 is transmitted via the insulating switching rod 7, without any galvanic connection between the drive bolt 8 and the connecting rod 6. Furthermore, after carrying out a drive movement in order to close the contact system of the vacuum interrupter 5, a contact force is transmitted through the helical compression spring arrangement 18 of the insulating switching rod 7 to the moving contact element in the closed state of the contact system of the vacuum interrupter 5 because, after the drive movement has been carried out and the drive bolt 8 has been locked, the spring force of the helical compression spring arrangement 18 acts on the connecting rod 6, and therefore on the moving contact element of the vacuum interrupter 5 through the helical compression spring arrangement 18 between the bottom area, and via the moving insulating body 10 of the drive bolt 8, which is latched in the latching groove 14.

As can be seen from FIG. 2, the arrangement of the helical compression spring arrangement 18 in particular ensures that the spring arrangement cannot tilt, because the helical compression spring or springs F or F1, F2 are guided in the spring cups 16, 17 and is or are stabilized against tilting. In particular, a helical compression spring arrangement 18 such as this makes it possible to produce large contact forces of 3500 to 5000 N with a working travel of between 0 and 5 mm with a compact physical volume, with the helical compression spring arrangement 18 having an average spring rate of 200 N/mm for an unstressed length of about 100 mm, and for a predetermined internal and external turn diameter. Depending on the nature and design of the helical compression spring arrangement 18, it may also have more than one helical compression spring. If it has a plurality of helical compression springs, these may, in particular, be wound in opposite senses.

Figure 3:
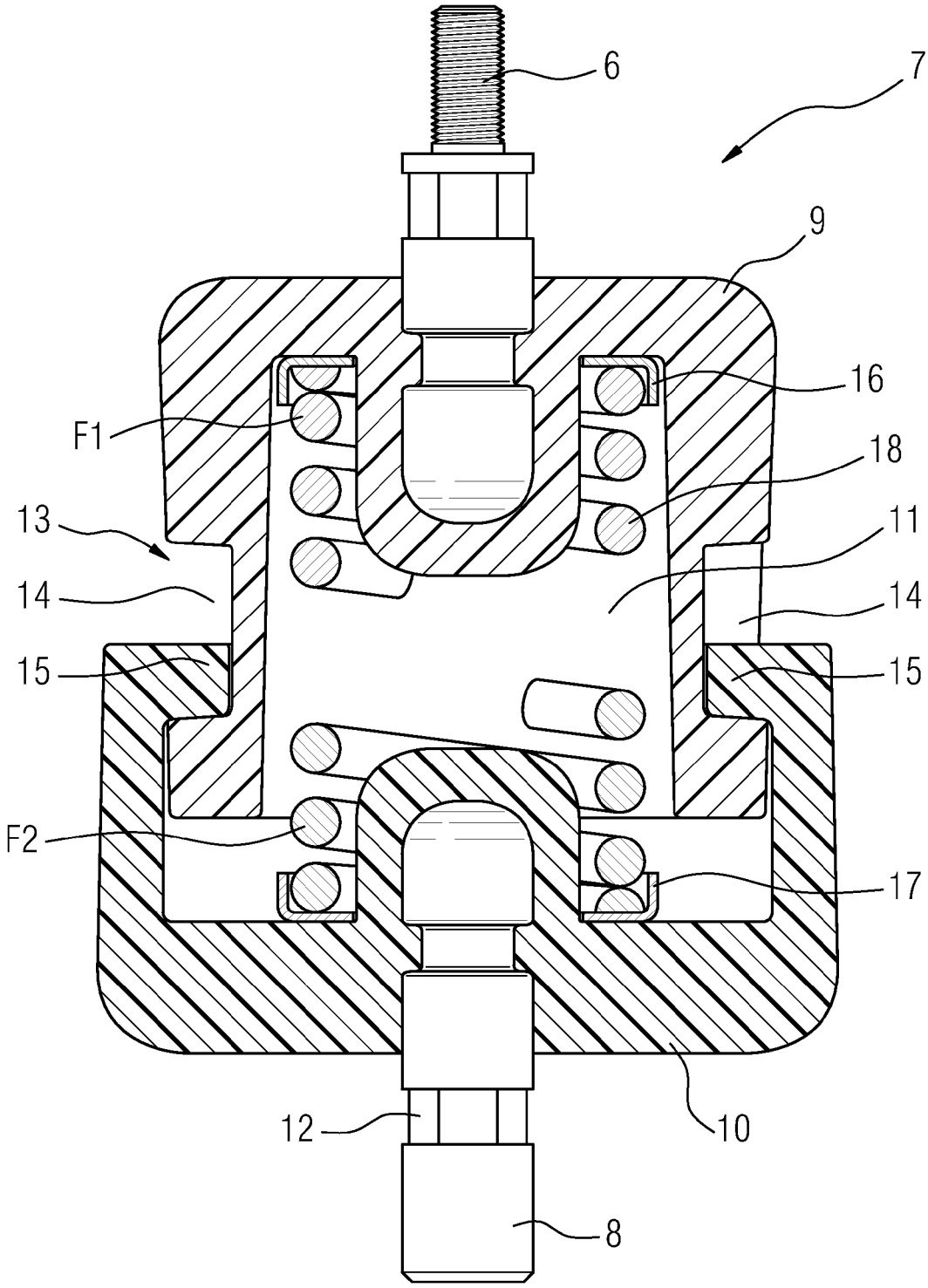
FIG. 3 shows a detail view of the insulating switching rod according to the invention with a drive element, with these having mutually associating plug and latchable insulating bodies with latching and guide grooves on the outside.
Figure 4:
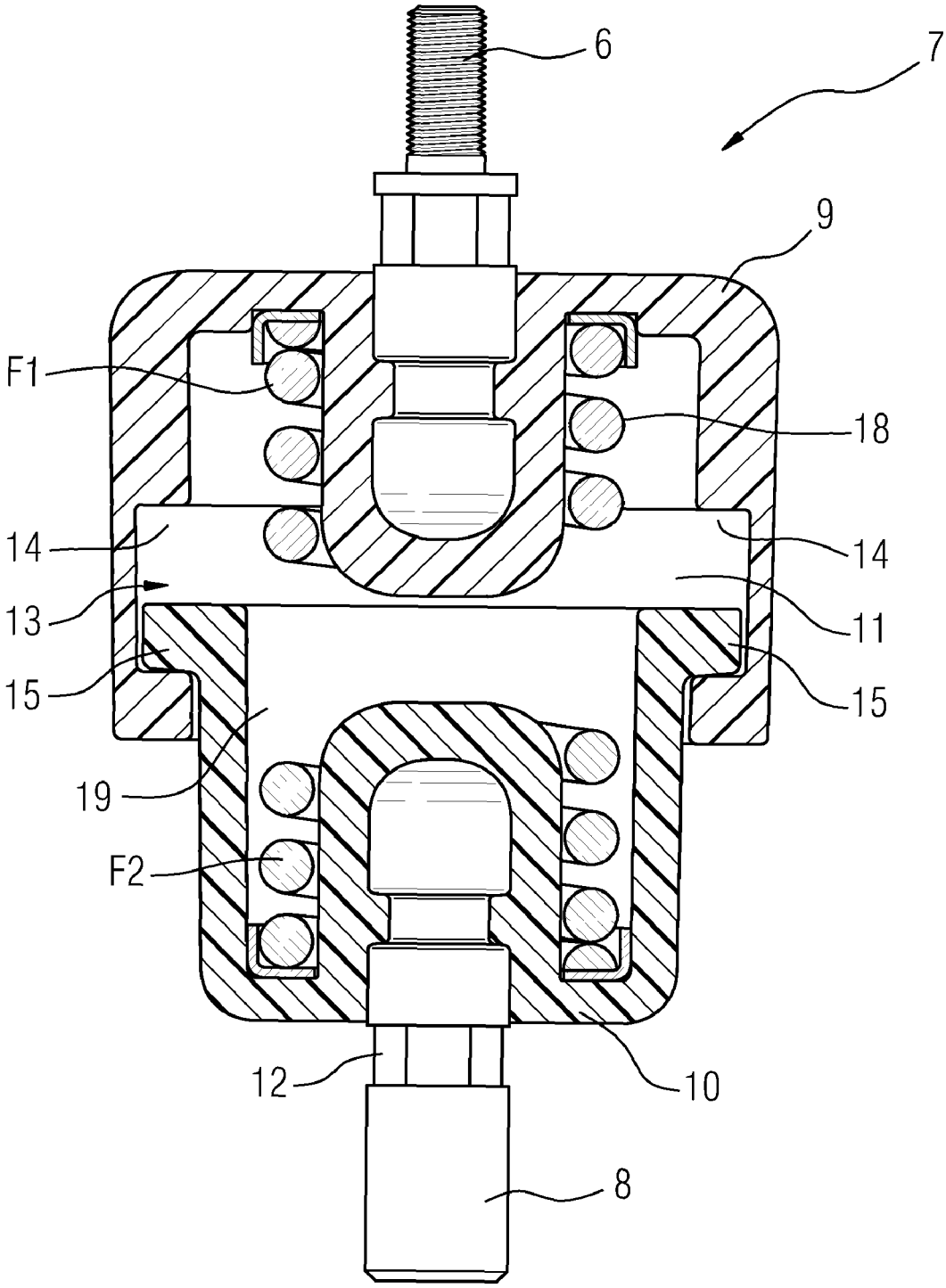
FIG. 4 shows a detail view of the insulating switching rod according to the invention with a drive element, with these having mutually associating plug and latchable bell-shaped insulating bodies with latching and guide grooves on the inside.
Figure 5:
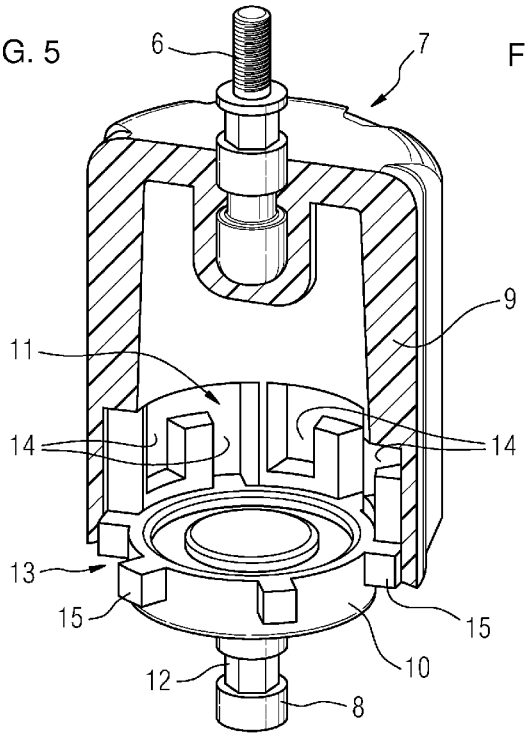
FIGS. 5 to 8 show, schematically in the form of a longitudinal section, one exemplary embodiment of an insulating switching rod according to the invention with a drive element, in which case these can be connected to one another in various plug and latching positions by means of a plug and latching connection, in the form of a bayonet fitting, of the switching rod and drive element.

FIGS. 3 and 4 show various exemplary embodiments of different housing shapes of the insulating bodies 9 and 10, and different plug and latching connections 13.

In FIG. 3, the latching groove 14 on the fixed insulating body 9 is incorporated on the outside in the wall thereof. The moving insulating body 10 has latching hooks 15 which correspond to the latching groove 14, clasp the fixed insulating body 10 and are guided in the latching groove 14 such that they can move longitudinally and can rotate therein, and can be latched in.

The insulating body 10 likewise has a cavity 19 in FIG. 4. The two insulating bodies 9 and 10 are in the form of bells which are plugged into one another, with the latching groove 14 being incorporated in the inner wall of the stationary insulating body 9, in which a cantilever arm of the insulating body 10 is guided as a latching hook 15, such that it can move longitudinally and can rotate, and can be latched in.

FIGS. 5 to 8 illustrate schematically in the form of a longitudinal section one exemplary embodiment of an insulating switching rod 7 according to the invention with a plug and latching connection 13, in the form of a bayonet fitting, of the switching rod 7 and the drive bolt 8, in various plug and latching positions. For this purpose, the moving insulating body 10 of the drive bolt 8 is inserted into the opening area and the cavity 11 in the stationary or fixed insulating body 9 and 10, in particular by being plugged in. Depending on the embodiment, both or only one of the two insulating bodies 9 and 10 can move during fitting/removal—and the two insulating bodies 9 and 10 can also be plugged into one another.

For plugging into one another or for insertion, the inner wall of one insulating body 9, in particular the fixed insulating body 9, has a plurality of latching grooves 14 distributed over the surface, in which latching hooks 15 which correspond to these latching grooves 14 on the other, in particular moving, insulating body 10 are guided. For this purpose, the latching hooks 15 project radially from the moving insulating body 10.

Figure 6:
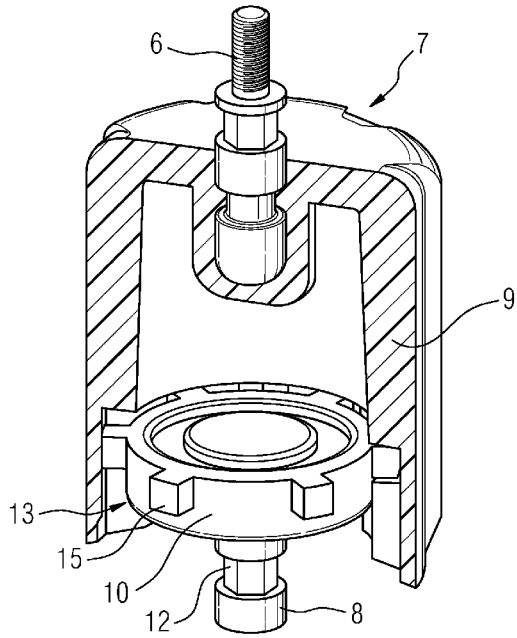
Figure 7:
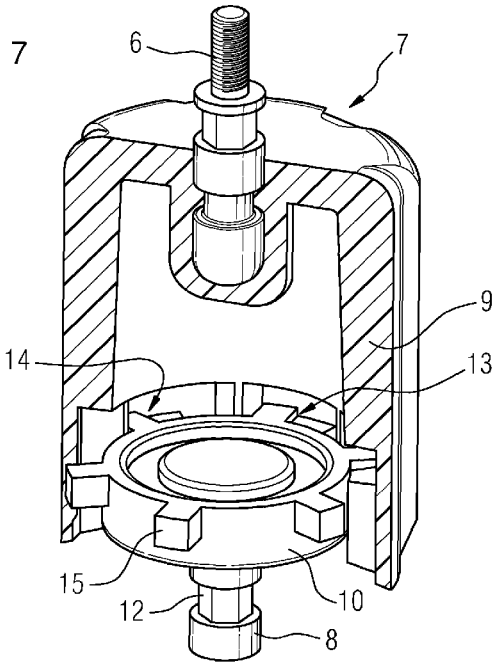
Figure 8:
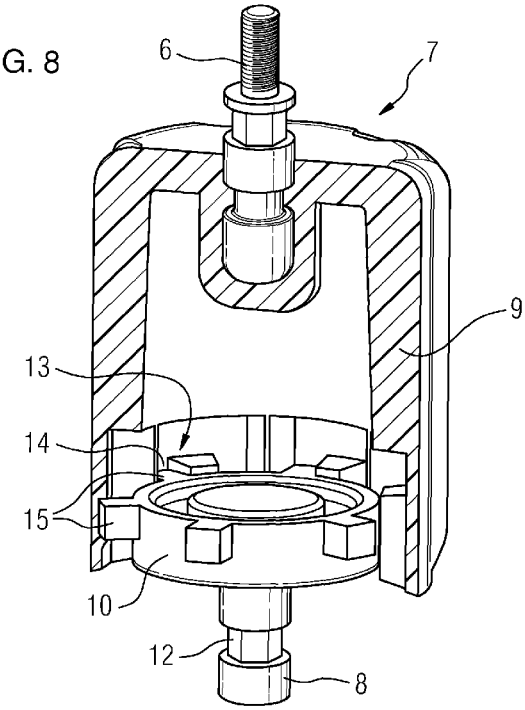

As is shown in FIG. 6, the two insulating bodies 9 and 10 are plugged into one another in the insertion direction as far as a stop, and at least one of the two insulating bodies 9 or 10, or both, is or are then rotated with respect to one another as far as a rotation stop, and is or are then moved as far as a latching stop, and in the opposite direction to the insertion direction, while it or they is or are connected in a latching manner, as is shown in FIGS. 7 and 8.

A plug and latching connection 13 such as this in the form of a bayonet fitting allows simple mechanical connection, which can be made and broken quickly, to be produced between the switching rod 7 and the drive bolt 8.

The embodiment of the plug and latching connection 13 illustrated in FIGS. 5 to 8 represent one exemplary embodiment, in which the number, type, shape and/or the profile of latching hooks 15 and/or latching grooves 14 may vary.

LIST OF REFERENCE SYMBOLS

1 Switch pole
2 Insulating material housing
3 First connecting piece
4 Drive unit
5 Vacuum interrupter
6 Connecting rod
7 Insulating switching rod
8 Drive bolt
9 Fixed insulating body
10 Moving insulating body
11 Cavity in the fixed insulating body
12 Connecting element
13 Plug and latching connection
14 Latching groove
15 Latching hook

16 Spring cup of the fixed insulating body
17 Spring cup of the moving insulating body
18 Stressing apparatus
19 Cavity in the moving insulating body
F, F1, F2 Helical compression springs

The invention claimed is:

1. An insulating switching rod assembly, comprising:

a drive element for introducing a drive movement into an electrical contact system of a switching device and for producing a contact force in a closed state of the contact system;

a stressing apparatus for said drive element of the switching rod in order to maintain the contact force;

a plug and latching connection for directly or indirectly connecting the switching rod and said drive element to one another; and an insulating body enclosing said switching rod and an insulating body enclosing said drive element, and wherein said insulating body of said switching rod and said insulating body of said drive element are configured to be plugged into one another and to be latched to one another.

2. The insulating switching rod according to claim 1, wherein said plug and latching connection is a bayonet fitting.

3. The insulating switching rod according to claim 1, wherein one of said insulating bodies is a fixed insulating body and the respectively other said insulating body can be movably plugged and latched into said fixed insulating body.

4. The insulating switching rod according to claim 1, wherein said insulating body of said switching rod is formed with a cavity, and said stressing apparatus is disposed in said cavity and comprises a helical compression spring assembly including at least one helical compression spring disposed around said switching rod.

5. The insulating switching rod according to claim 4, wherein said stressing apparatus further includes a helical compression spring disposed around said drive element.

6. The insulating switching rod according to claim 1, wherein said stressing apparatus comprises a plurality of separate helical compression springs, each arranged around at least one of said drive element and said switching rod.

7. The insulating switching rod according to claim 1, wherein said insulating bodies are formed on an inside and/or on an outside thereof with at least one latching groove and/or with at least one latching hook.

8. The insulating switching rod according to claim claim 1, wherein said insulating bodies are formed with at least one latching groove and at least one latching hook, respectively.

9. The insulating switching rod according to claim 1, wherein said insulating bodies are provided with mutually corresponding latching grooves and latching hooks which, when plugged together, engage into one another in an interlocking and force-fitting manner.

10. An insulating switching rod assembly, comprising:

a drive element for introducing a drive movement into an electrical contact system of a switching device and for producing a contact force in a closed state of the contact system;

a stressing apparatus for said drive element of the switching rod in order to maintain the contact force, said stressing apparatus including a plurality of mutually interleaved helical compression springs, each arranged around at least one of said drive element and said switching rod, and a plug and latching connection for directly or indirectly connecting the switching rod and said drive element to one another.

* * * * *